US008221293B2

(12) United States Patent
Hoffman et al.

(10) Patent No.: US 8,221,293 B2
(45) Date of Patent: Jul. 17, 2012

(54) CORE STABILIZING RUNNING EXERCISE SYSTEM AND APPARATUS

(75) Inventors: Jonathan Hoffman, Herzelia Pituach (IL); Amit Barak, Tel Aviv (IL)

(73) Assignee: Balanced Body, Inc., Sacramento, CA (US)

( * ) Notice: Subject to any disclaimer, the term of this patent is extended or adjusted under 35 U.S.C. 154(b) by 0 days.

(21) Appl. No.: 13/078,685

(22) Filed: Apr. 1, 2011

(65) Prior Publication Data

US 2011/0230314 A1 Sep. 22, 2011

Related U.S. Application Data

(63) Continuation-in-part of application No. 12/700,961, filed on Feb. 5, 2010, now Pat. No. 8,088,045.

(60) Provisional application No. 61/207,083, filed on Feb. 9, 2009.

(51) Int. Cl.
*A63B 71/00* (2006.01)

(52) U.S. Cl. ..... 482/8; 482/51; 482/54; 482/69; 482/74

(58) Field of Classification Search ..... 482/1–9, 482/14, 54, 69, 74, 900–902; 434/247
See application file for complete search history.

(56) References Cited

U.S. PATENT DOCUMENTS

| | | | | |
|---|---|---|---|---|
| 5,234,392 | A | 8/1993 | Clark | |
| 6,004,243 | A | 12/1999 | Ewert | |
| 6,059,696 | A * | 5/2000 | Bohmer et al. | 482/54 |
| 6,319,179 | B1 | 11/2001 | Hinds | |
| 7,494,450 | B2 * | 2/2009 | Solomon | 482/69 |
| 7,608,015 | B2 | 10/2009 | Radow | |
| 2006/0199711 | A1 | 9/2006 | Miers | |

OTHER PUBLICATIONS

International Search Report and Written Opinion, dated Mar. 19, 2012, from corresponding International Application No. PCT/US2011/043498.

* cited by examiner

*Primary Examiner* — Glenn Richman
(74) *Attorney, Agent, or Firm* — Greenberg Traurig, LLP

(57) ABSTRACT

An exercise apparatus in this disclosure includes a doorway mountable runner restraint device. The device has a generally rigid, preferably padded, belly pad that is placed against and in front of a user's pelvis and abdominal area. A pair of cords are attached to the belly pad, each having an opposite end attached to an elastic member. Each of the elastic members is, in turn, attached to an anchor which is removably fastened to a stationary object such as a closed door, a doorway frame, or sandwiched between a closed door and the doorway frame. A user fastens the apparatus in place in a doorway, faces away from the doorway, and places the belly pad against his or her torso directly over the pelvis area, and then runs in a direction away from the doorway. The elastic members resist and restrain the user from substantial movement away from the doorway but stretch to allow forward running movement during each step.

9 Claims, 10 Drawing Sheets

CORE STABILIZING RUNNING EXERCISE SYSTEM AND APPARATUS

CROSS REFERENCE TO RELATED APPLICATIONS

This application is a continuation-in-part of U.S. patent application Ser. No. 12/700,961, filed Feb. 5, 2010, which claims the benefit of priority of U.S. Provisional Application Ser. No. 61/207,083, filed Feb. 9, 2009, entitled A Running And Exercise Device. This provisional application is incorporated herein by reference in its entirety.

BACKGROUND OF THE DISCLOSURE

1. Field of the Disclosure

The present disclosure relates to an exercise apparatus and more particularly for an exercise device to assisting runners maintain core stability while running in place.

2. State of the Art

Various devices are known to permit a person to simulate a run in a generally confined space. Such devices include treadmills, both self powered and powered, stepping platforms, etc. In addition, one can attach one end of an elastic cord to a stationary frame or doorway, wrap the other end around the person's torso to provide resistance while leaning forward and running in place.

The elastic cord type of stationary exercise device is simple, inexpensive, easy to transport, and easy to set up and use. However, such a device does not provide any useful feedback to the user and is extremely boring to use. Further, such prior art devices are uncomfortably restraining to the user during exercise and tend to slip during use.

SUMMARY OF THE DISCLOSURE

An interactive exercise monitoring system in accordance with this disclosure includes a doorway mountable runner restraint device including a belly pad having two or more force/pressure sensors embedded therein connected to one or more transmitters. Each sensor senses force applied by a user/runner against the pad during exercise. A receiver/controller is operably coupled to the one or more transmitters and is operable to receive signals from the sensors and generate one or more indications correlated to the sensed forces. These indications are then sent to a display connected to the receiver/controller for displaying the indications.

The system may also include a stationary collapsible frame connected to the restraint device having a cushioned support pad for supporting a user on a floor support surface. The runner restraint device comprises an elongated generally rectangular belly pad having a cord fastened to each end of the pad. Each cord has another end connected to an elastic member which is in turn removably attached to an upright member of the frame. Preferably the restraint device further has a safety strap fastened between the frame and each cord.

An exercise apparatus in accordance with the present disclosure basically includes a runner restraint device. The runner restraint device is adapted to be mounted or fastened to a stationary object such as a stationary frame, a doorway, door, wall, ceiling, or other stationary structure. The device has a generally rigid, preferably padded, belly pad that is placed against and in front of a user's pelvis and abdominal area. A pair of cords are attached to the belly pad, each having an opposite end attached to an elastic member. Each of the elastic members is, in turn, attached to an anchor which is removably fastened to the stationary object, e.g. a door, a doorway frame, or sandwiched between a closed door and the doorway frame. A user, for example, fastens the apparatus in place in a doorway, faces away from the doorway, and places the belly pad against his or her torso directly over the pelvis area, and then runs in a direction away from the doorway. The elastic members resist and restrain the user from substantial movement away from the doorway but stretch to allow forward running movement.

Another embodiment of the apparatus preferably has a first cord having one end connected to one end of the belly pad and an opposite end connected to one end of an elastic member. An another end of the elastic member is connected to a strap fastened to an anchor member. A second cord has one end connected to the other end of the belly pad and an opposite end connected to one end of another elastic member. The other end of the another elastic member is connected to a second strap fastened to the anchor member, at a location spaced from the first strap. A spreader bar may be positioned between the first and second cords to maintain a spaced relation between the first and second cords during use.

These embodiments my include force/pressure sensors. In both embodiments the sensors are spaced laterally apart in the belly pad such that, in use, one sensor is positioned adjacent a user's right hip and the other sensor is positioned adjacent the user's left hip. The system further preferably has a video playback device operably connected to the display and to the controller. The sensor signals processed in the controller my optionally control the frame repetition rate of a video being processed in the video playback device and displayed on the display device such that a user can voyeuristically run along a path simulation shown on the video display device.

Another embodiment of the runner restraint device adapted to be elastically tethered to a stationary object preferably may include a generally rigid padded belly bar/pad having a generally elongated curved body portion. This body portion has a vertical rib adjacent each opposite end and a pair of laterally spaced vertical recesses defining each of the vertical ribs. Each recess has a pair of vertical slots therein. A first strap has one end extending through one of the vertical slots and another end extending through the other vertical slot in one of the vertical recesses. These ends of the first strap are removably retained in the vertical recesses by a rod carried in that vertical recess. A second strap similarly has one end extending through one of the vertical slots in a vertical recess adjacent the other end of the body portion. The ends of the second strap are removably retained in the vertical recesses by another rod carried in that vertical recess. A first cord has one end connected to the first strap and an opposite end connected to one end of an elastic member. Another end of the elastic member is connected to an anchor member, typically fastened to an object such as a closed door jam. Similarly a second cord has one end connected to the second strap and has an opposite end connected to one end of another elastic member. This other elastic member has another end also connected to the anchor member.

BRIEF DESCRIPTION OF THE DRAWINGS

The present disclosure will be better understood and objects, other than those set forth above, will become apparent when consideration is given to the following detailed description. Such description makes reference to the accompanying drawings wherein.

DETAILED DESCRIPTION

In the following description, numerous specific details are set forth in order to provide a more thorough disclosure. It will be apparent, however, to one skilled in the art, that the art disclosed may be practiced without these specific details. In some instances, well-known features may have not been described in detail so as not to obscure the art disclosed.

Figure 1:
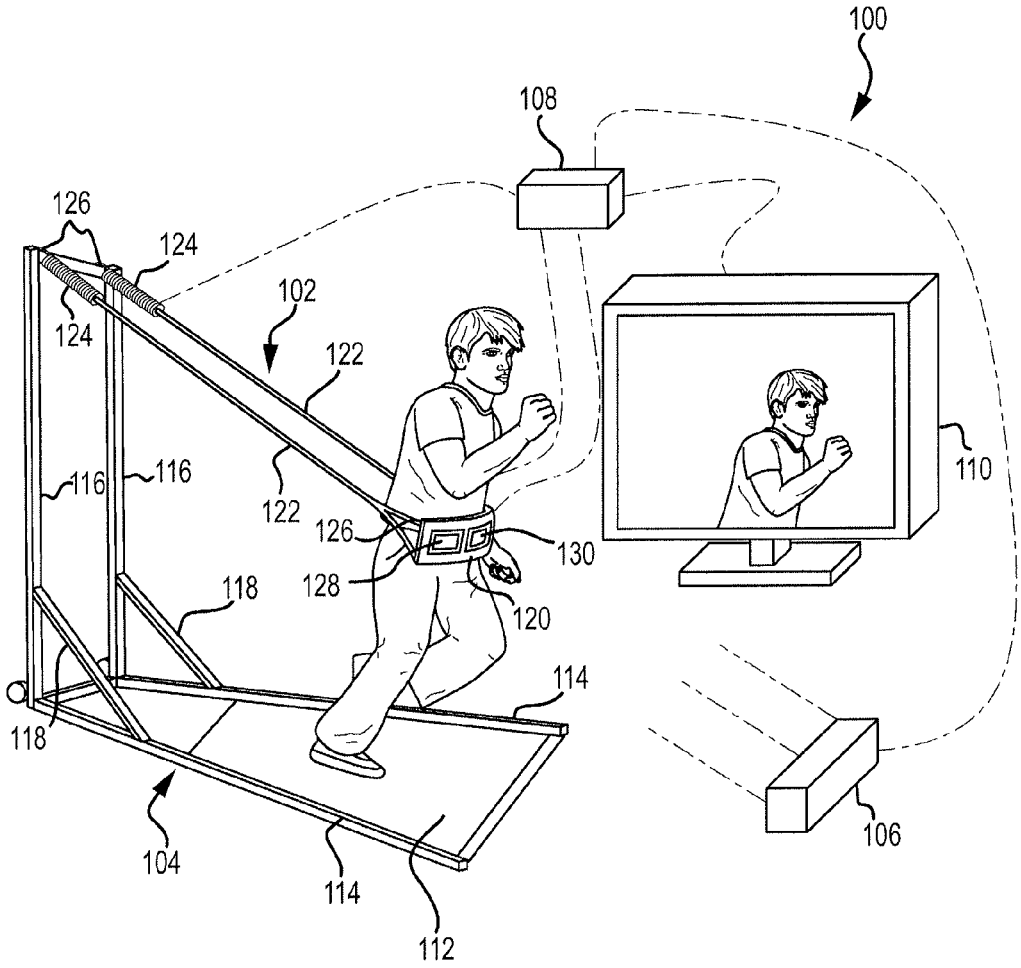
FIG. 1 is a perspective view of a first embodiment of a runner restraint exercise system, in accordance with this disclosure, being used by a person running in place.

A perspective view of an interactive runner restraint exercise system 100 incorporating a first embodiment of a runner restraint exercise apparatus 102 of the present disclosure is shown in FIG. 1. This particular system 100 includes a generally L shaped collapsible frame 104 supporting the apparatus 102, a camera 106, a receiver/controller 108, and a display 110.

Figure 2:
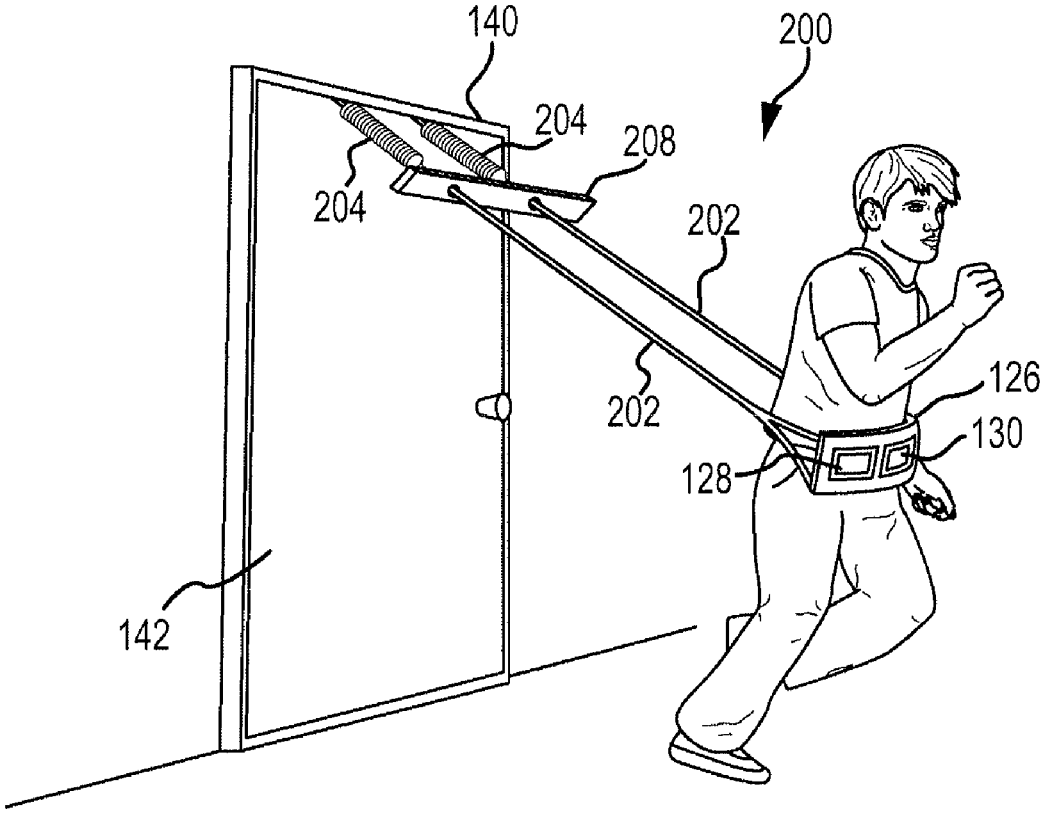
FIG. 2 is a perspective view of a person using another embodiment of the runner restraint exercise apparatus shown in FIG. 1, in accordance with the present disclosure, wherein the exercise apparatus is fastened to a preexisting door/doorway.

The frame 104 includes a cushioned runner support pad 112 attached to spaced side frame members 114. The support pad 112 rests on a floor support surface (not shown) and provides a secure, cushioned surface on which the runner can stand and run in place. The side frame members 114 are hinged to upright frame members 116 that are in turn releasably held rigidly upright by braces 118. The frame 104 can preferably be collapsed for storage beneath a bed or in a closet or other convenient location. Alternatively, the exercise apparatus 102 may be attached to a doorway as is shown in FIG. 2 and thus the frame 104 would be unnecessary in the embodiment shown in FIG. 2.

An embodiment of the runner restraint exercise apparatus 102 includes a pair of cords 122 that each have one end fastened to one end of an elastic member 124. The other end of each cord 122 is attached to one side of a belly bar/pad 126. As shown in FIG. 1, the other end 125 of each elastic member 124 is removably fastened to the top of the frame 104. Alternatively, this end 125 may be secured to a doorway 140 as shown in FIGS. 2 through 5 and explained in detail below.

Figure 3:
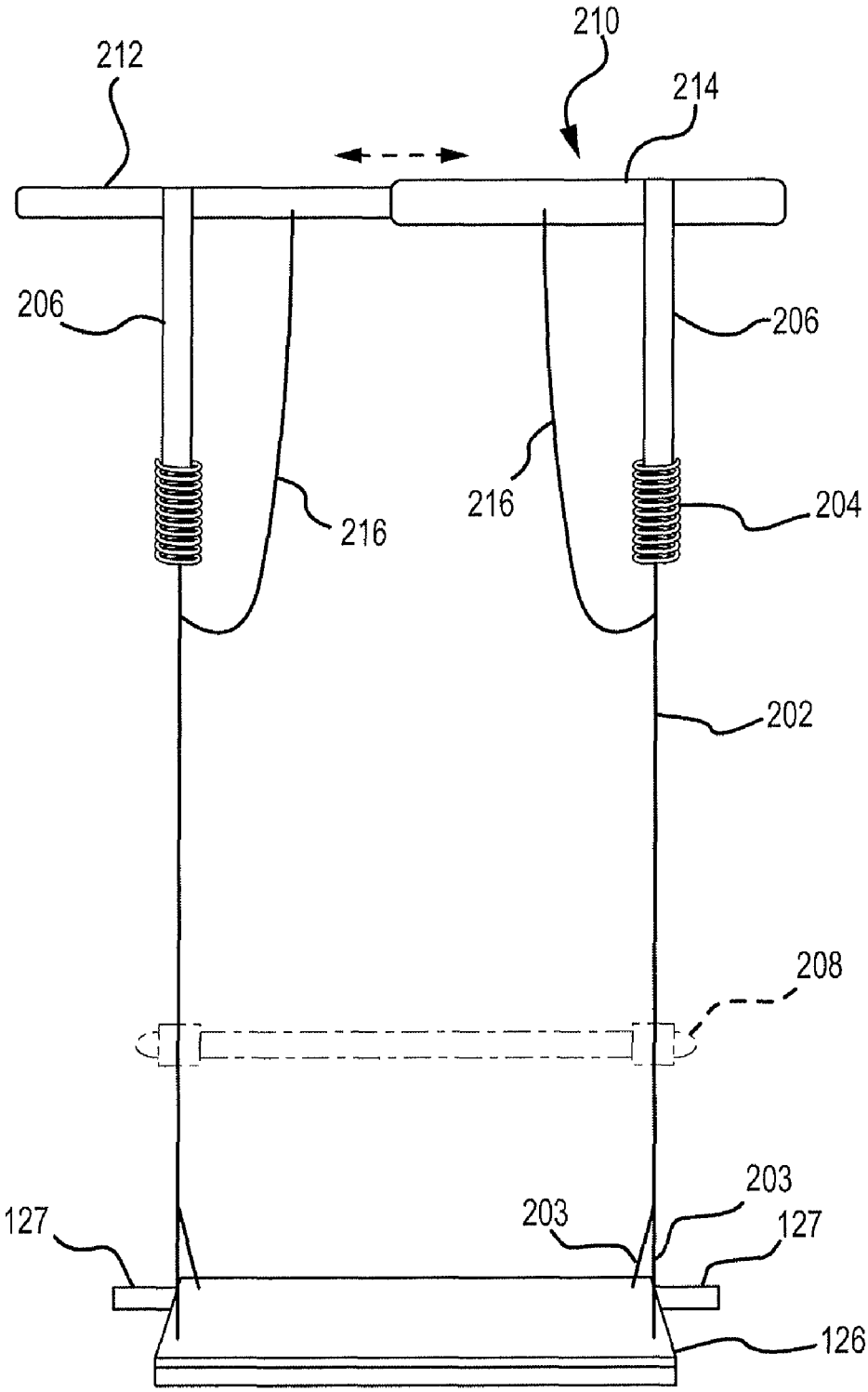
FIG. 3 is a front perspective view of another embodiment of the runner restraint exercise apparatus of the present disclosure.

The belly bar/pad 126 is a generally rectangular, preferably rigid, pad preferably cushioned or covered with soft material such as a closed cell polymeric foam for comfort during use. This bar/pad 126 may be a flat rectangular plate as is shown in FIG. 3, or may be curved and shaped for comfort anatomically complementary to a user's pelvic/abdominal area. Preferably the pad structure should have a rigid base layer which is form fitting to the user's body at the height of the upper pelvis/lower abdominal area. This will permit a user to spread the forces evenly among areas in contact with the belly bar and run without compressing the pelvic joints or other portions of the body, thus providing a unique, free run, feel. The width, or long axis, of the pad 126 is long enough, i.e., wide enough, so that it preferably does not extend outward beyond a user's pelvis so that the user's arms can swing freely during exercise without hitting the pad 126. The height of the pad should sufficient for comfort but not so high as to interfere with leg motion or breathing. One exemplary pad measures about 42 cm by 12 cm. The pad 126 may be made of wood, metal, plastic, or a composite material and may be solid or hollow. As mentioned above, a cushion may be integrated onto the pad for comfort. This cushion may be removable and could have different shapes for different users.

A covering on this pad 126 is preferably made of a friction or nonslip material such that during use it does not ride up or down on the user's torso from the pelvis during exercise. Should a user be wearing loose cotton or nylon clothing, for example, a wide belt (not shown) or wrap of nonslip material, such as a rubber faced web belt, could be worn around the user's waist and hips to engage the nonslip surface covering of the bar/pad 126.

Preferably each of the cords 202 connects via a metal ring to a looped rope attached to either end of the pad 126. In this way the restraining force applied by the elastic members 204 will be distributed to the pad 126 generally perpendicularly rather than at unpredictable angles. This configuration facilitates more accurate force/pressure measurements.

As can be readily seen in FIG. 3, the pad 126 may be equipped with a pair of side handles 127. The user may grasp these handles 127 during certain exercise routines. The handles 127 may be the ends of a single rod that passes beneath or through the pad 126, or they may be detachable or hinged to the pad 126 such that they may be folded out of the way to permit a user's arms to freely swing past the ends of the pad 126 as in FIGS. 1 and 2.

Embedded within the pad 126 may be two or more sensors 128 and 130. Each of the sensors 128 and 130 can detect fluctuations in force/pressure applied by the user's body against that portion of the pad and sends signals to the receiver/controller 108 where the force/pressure signals are processed for display on the display 110.

Each of the pressure sensors 128 and 130 preferably may include an accelerometer and/or a piezo-resistive strain gauge element coupled to an amplifier and transmitter for preferably short range wireless transmission, via Bluetooth, for example, of the force/pressure signals to the receiver 108. The receiver 108 in turn processes the force/pressure signals for display on the display 110. The sensors 128 and 130 may also be mechanically coupled to the handles 127 shown in FIG. 3 such that, when these handles are used, force/pressure signals applied by the user to the handles 127 are sent to the receiver/controller 108.

Optionally the receiver 108 may also receive a strain gauge signal from the elastic members 124 as indicated by the dashed line in FIG. 1. This strain gauge signal from the elastic members 124 can be processed in the receiver to correlate the forces with spring characteristics and hence determine the calories burned by the runner during exercise. Further, the receiver 108 may receive heart rate, respiration, or other body physiological data from sensors attached directly to the user's body.

The pressure signals from the sensors 128 and 130 are primarily displayed to the runner to show any side to side imbalance in the runner's abdominal core contact areas, with the objective that the runner adapt his or her stride and posture during exercise to maintain an even force/pressure distribution display. This, in turn, gives the runner real time visual feedback of his/her running style and/or conditions during an exercise.

The display 110 may also be configured to display a prerecorded video of a running course, for example, a run through a countryside path, along with display of time, pace, and the force and pressure data. Further, the signals from the sensors 128 and 130 can be processed by the receiver/controller 108 to calculate equivalent speed and distance traveled. This speed and distance information may be utilized in the controller 108 with the prerecorded video to control its frame repetition rate on the display device 110, and hence give the runner the sense that he or she is running along the path shown in the video on the display device 110.

One such control scheme for controlling video frame repetition rate is disclosed in U.S. Pat. No. 6,004,243, which is hereby incorporated by reference in its entirety. The video display device 110 has another use as well. The camera 106 can display a real time image of the runner during exercise in conjunction with display of the sensed forces via sensors 128 and 130. When the camera 106 feeds video picture of the runner to the display device 110, the runner can watch his or her image thereon to immediately assess running posture, gait, etc. and monitor the displayed forces sensed by sensors 128 and 130 to strive for a balanced form and thereby improve physical performance during exercise.

Figure 4:
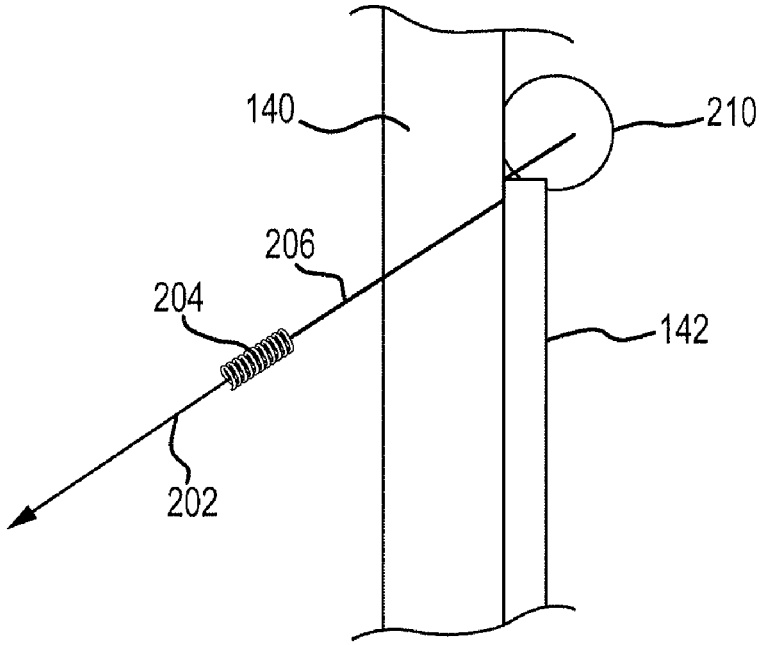
FIG. 4 is a partial side view of a doorway configuration to which the exercise apparatus in FIGS. 2 and 3 is attached.
Figure 5:
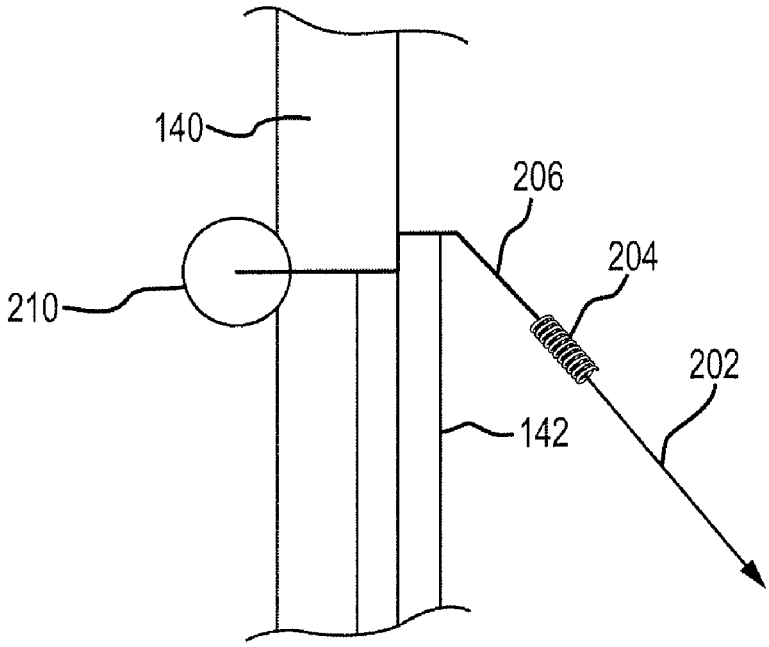
FIG. 5 is an alternative side view of a doorway configuration to which the exercise apparatus in FIGS. 2 and 3 is attached.

A second embodiment of the exercise apparatus 200 in accordance with the present disclosure is shown in FIG. 2 and separately in FIGS. 3-5. The apparatus 200 includes a pad 126 having a pair of embedded sensors 128 and 130 as in the first embodiment 100. In this embodiment 200 the sensors 128 and 130, may send wireless signals to the receiver 108 as in FIG. 1 or alternatively may locally display or store the information within the pad 126 for later review. This apparatus 200 again has a pair of cords 202 each having one end fastened to an end of the pad 126 and the other end fastened to one end of an elastic member, such as a coil spring 204. An opposite end of each elastic member 204 is attached to a flexible but non-elastic band or strap 206. Each of the cords 202 pass through a hole near one end of a spreader bar 208. This spreader bar 208 maintains the cords 202 in a generally parallel relation behind the user/runner while running so that a proper distribution of forces applied by the user to the pad 126 is maintained. The position of the spreader bar 208 may be adjusted by sliding the spreader bar 208 along the cords 202.

It is to be noted at this point that the spreader bar 208 is optional and may be needed if the apparatus 200 is fastened in a doorway frame at a single point, which is not illustrated. The spreader bar 208 may be dispensed with if an anchor bar as described below is used, since the anchor bar 210 maintains proper spacing between the cords and straps. Alternatively, the spreader bar 208 may be utilized in exercises where a user run backwards utilizing the device 200, and the belly pad 126 is positioned against the user's buttocks. In such a situation it may be advantageous for the user to grip the spreader bar 208.

One end of each of the straps 206 is fastened to an anchor bar 210 as is shown in FIG. 3. The straps or bands 206 are preferably made of a flexible, non stretchable fabric such as cotton or nylon webbing. The anchor bar 210 may be a single dowel rod or may be a telescopic assembly of a male member 212 and female member 214 as is shown in FIG. 3. The telescopic anchor bar assembly may be spring loaded so that it can fit within a doorway against the back side of a door 142, or may be threaded together or alternatively be mechanically lockable at various lengths. This anchor bar 210 is designed to fit behind the top edge of a closed door 142 with the bar 210 preventing the straps 206 from being withdrawn from the door 142 through the doorway 140 as is shown in FIGS. 4 and 5.

Also fastened to the anchor bar 210 is one end of a pair of safety cords 216. These safety cords 216 have their other ends each fastened to one of the cords 202 such that over extension of the springs 204 is prevented. These safety cords 216 may be external of the springs 204 as shown, or alternatively may be threaded through the length of each of the springs 204 and attached to the straps 206 rather than the anchor bar 210.

Each of the alternative configurations shown in FIGS. 3-5 may be utilized as part of the system 100 shown in FIG. 1.

Figure 6:
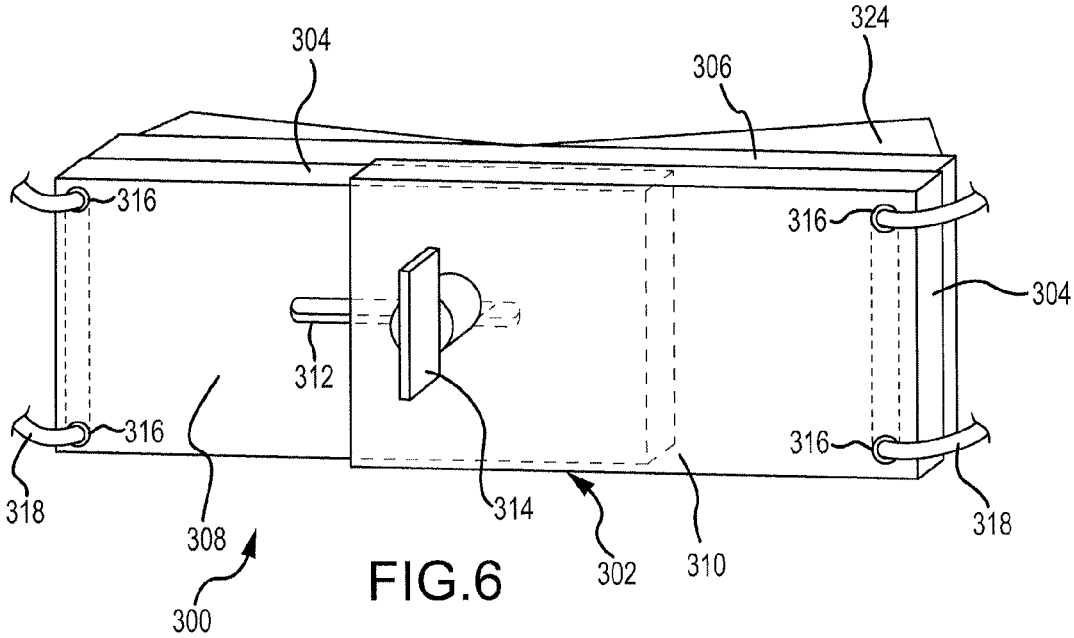
FIG. 6 is a separate enlarged perspective front view of an adjustable belly pad in accordance with the present disclosure.

An exemplary embodiment of an adjustable belly pad assembly 300 for use in either the system 100 or the apparatus 200 is shown in a front perspective view in FIG. 6. The pad assembly 300 comprises a telescopically adjustable support tray 302 receiving a cushion pad 306 therein. In the embodiment illustrated, the tray 302 is an elongated generally flat tray with angled or curved side edges 304 shaped to hold the cushion pad 306 securely in place therein. Alternatively the adjustable tray 302 may be curved and anatomically shaped about a typical user's pelvic and abdominal area, as is schematically represented in FIGS. 1 and 2.

The adjustable tray 302 is preferably made in two sections. A first section 308 is telescopically received in a second section 310. The distance between the side edges 304 on the first section 308 is slightly less than the distance between the side edges 304 of the second section 310 such that the side edges 304 on the second section form a guide for the side edges of the first section 308. The tray sections 308 and 310 are each preferably constructed of a rigid material such as a molded plastic sheet material or made of a stamped sheet metal.

Each of the sections 308 and 310 may be generally identical in shape except that Section 308 has an elongated blind slot 312 extending parallel to and along a longitudinal axis of the tray 302 and centered between the upper and lower side edges 304 of the tray 302. The second section 310 has a hole, that, when the sections are nested together, is centered over the slot 312 through which a threaded bolt (not visible) extends. This bolt is, in turn, threaded into a wing-nut fastener 314. When the wing-nut fastener is tightened, the first and second sections are drawn together securely. It is to be understood that the type of fastener assembly shown (bolt/wing-nut) is merely exemplary. Many other means of removably fastening sections 308 and 310 together will be apparent to those skilled in the art.

The length of the tray 302 may be adjusted by sliding the first and second sections 308 and 310 together, or pulling them apart, until a desired length is achieved. The optimal length of the tray 302 preferably corresponds to a user's hip width at the top of the pelvis. For example, if one user has a hip width of 14 inches, then the tray length should be adjusted to be approximately 14 inches. In this way, the belly pad 300 will not extend beyond the user's hips and thus will not hinder the user's arm swing during exercise. When the desired length is set, the wing-nut fastener 314 is tightened to set the length of the tray 302.

When the tray length is set, the pad 306 is cut to length so as to fit snugly within the edges 304 around the tray 302. The pad 306 may further be held in place in the tray 302 by an adhesive strip, or complementary hook and loop fabric strips, adhesively attached to the tray sections 308 and 310 and to the pad 306. This pad 306 is preferably a closed cell foam pad that provides some cushioning for the user and also may provide a mounting location or locations for the sensors described elsewhere in this specification.

Near opposite ends of the tray 302 and adjacent outer corners of the tray 302 are a pair of spaced holes 316. A cord 318 extends out of one hole and passes through a ring 320 and then back through the other of the pair of holes 316. The cord 318 may have a knotted end inside the tray 302 at each hole 316 or it may be an endless loop that passes through the holes and through the ring 320 and back.

The ring 320 may be a solid ring or could alternatively be a round carabiner or split ring that permits the cord 318 to be removably joined to the cord 202 shown in FIG. 2. It is to be understood that cord 318 performs the same function as cord legs 203 in FIG. 2. The belly pad assembly 300 fastened to cords 202 via rings 320 ensures that the forces transmitted from the user to the cords 202 are optimally distributed during exercise. By sliding freely on cord 318, the angle of the tray 302, and hence the belly bar assembly 300, is separated from the angle of pull on the cord 202, thus facilitating equalized pressure forces between the top and bottom of the belly pad when in use.

Alternatively, the cord 318 could be replaced with a rigid "D" shaped structure to which the ring 320 is attached such that the ring 320 is free to slide along the curved portion of the "D" shape. Such a configuration would have the straight portion of the "D" shaped structure hinged to the end of the belly pad tray 302. A still further alternative would replace the "D" shape with a "C" shape rigid member that has its ends hooked into holes at the upper and lower end corners of the tray 302. The ring 320 would then clearly freely slide up and down the "C" shaped portion as described above. Such "C" shaped or "D" shaped structures may be made of metal or plastic material and may be hinged to the tray 302 or mounted in a fixed position.

Figure 7:
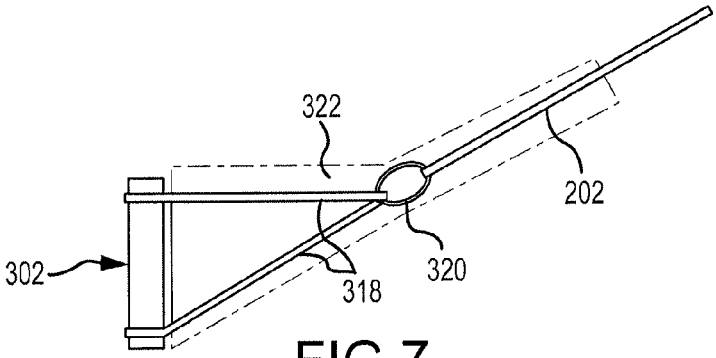
FIG. 7 is a side view of an exercise apparatus incorporating the belly pad shown in FIG. 6.

In certain alternative embodiments, the cords 318 as shown in FIG. 7 may be fastened to the ring 320 in such a manner that the ring 320 is maintained at a fixed location on the cord 318 in order to provide a set angle with respect to the tray 302. In such arrangement the ring 320 may be replaced with an adjustable connector such as a spring loaded clamp that clamps to one location on the cord 318 to maintain the fixed angle, or fixed segment lengths of cord 318 rather than having a sliding connection.

The assembly of cords 202, ring 320 and cord loop 318 may optionally be covered by a Y-shaped soft fabric or neoprene sleeve 322 in order to minimize interference with the user's arm movements and friction discomfort during exercise. This sleeve 322 may be fastened in place around the cords 202, ring 320 and loop 318 via hook and loop material such as Velcro or other suitable closure materials. Alternatively, the sleeve 322 may simply be an extension of and part of a cushion fabric cover that covers the entire pad assembly 300.

One or more force sensors may also be incorporated into the ring 320. In such an implementation, the sensor could include a piezoresistive strain gauge coupled to a miniature amplifier to provide a wireless signal to the controller 108 as above described. Such a sensor could detect directly the force applied to the cord 202 attached thereto. Additional sensors may be embedded into pad 306 of the belly pad assembly 300 so that additional characteristics related to the physical structure and exertion by the user may be monitored and transmitted to the controller 108 for subsequent display and/or analysis.

Additional cushioning wedges 324 may be attached to the pad 306 in the assembly 300. These wedges 324 may be useful in adjusting the fit of the apparatus 300 to an individual user. Such wedges 324 may preferably be attached via hook and loop fastener strips attached to the complementary surfaces of the pad 306 and wedge 324 so that fit can be easily adjusted. These wedges 324 may also be used when a user has one side of the pelvis weaker than the other.

Figure 8:
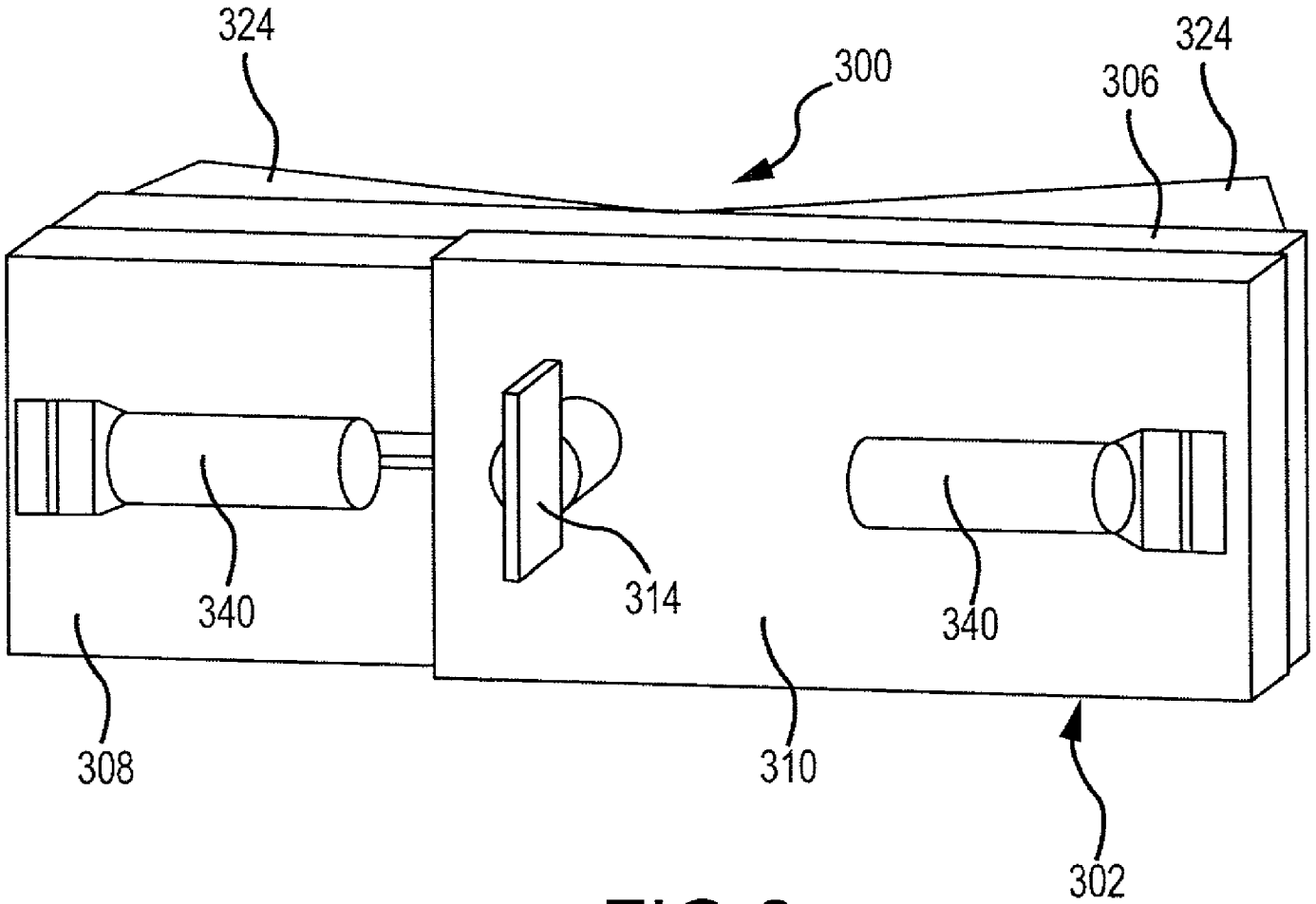
FIG. 8 is a separate perspective view of an adjustable belly pad having folded handles in accordance with the present disclosure.
Figure 9:
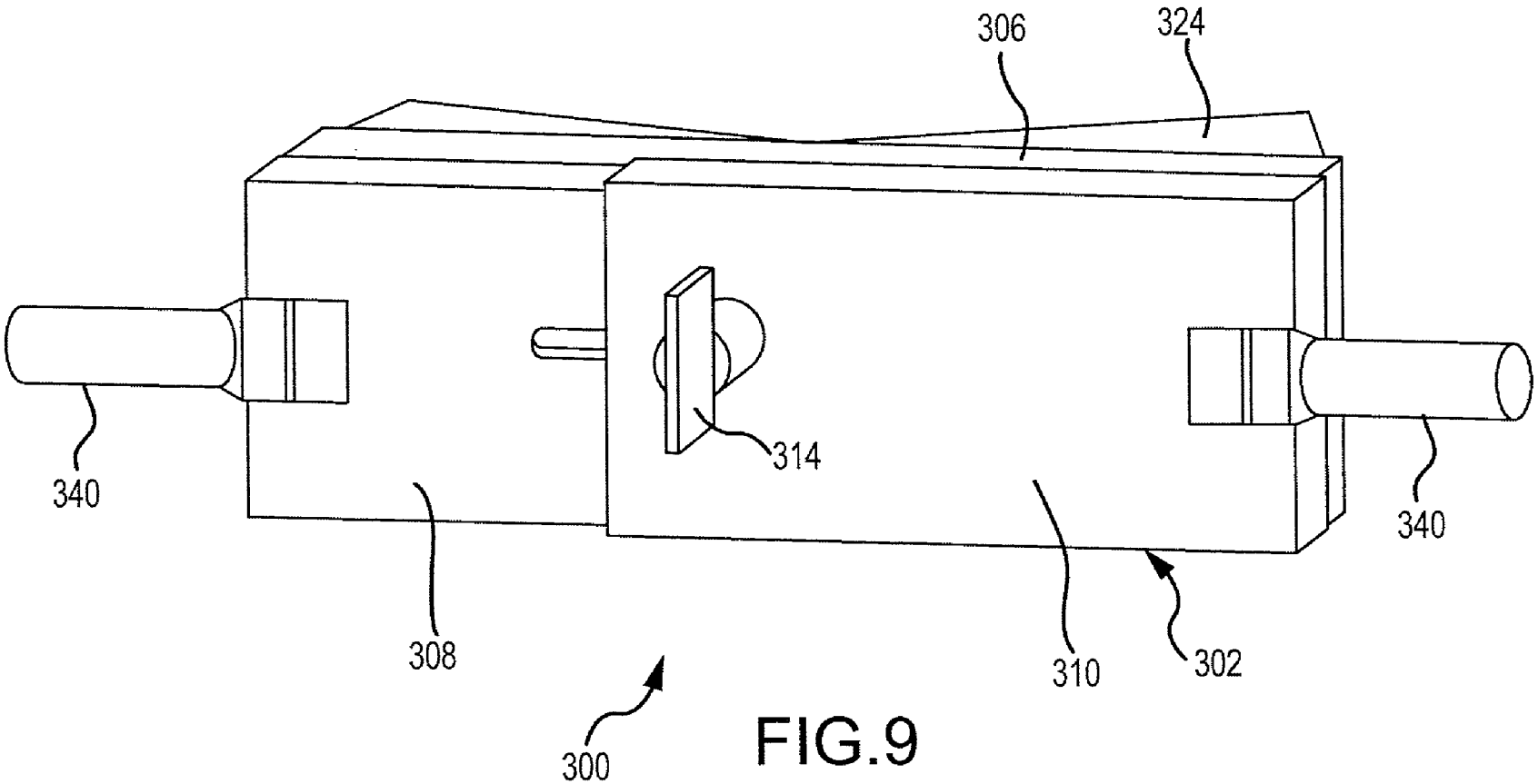
FIG. 9 is a separate view of the belly pad shown in FIG. 8 with the handles unfolded.

A further embodiment of the belly pad assembly 300 is shown in FIGS. 8 and 9. A hinged handle 340 may be optionally attached to the front, or outer, surface of each section 308 and 310 of the tray 302. This hinged handle 340 may be spring biased to the folded position, and then latched in an open position as shown in FIG. 9. Each of the handles 340 may be grasped by the user while running in place during certain exercise regimens or to provide a sense of stability for the user. In addition, these handles 340 may be used to hold the assembly in position during exercises where the user reverses his or her position, i.e., faces away from the belly pad assembly 300 during a particular exercise regimen. In addition, although not specifically shown, the handles 340 may be fitted with latches to lock them in the extended positions.

Various modifications and alternatives to the disclosed embodiments will be apparent to those skilled in the art. For example, a rounded belly bar/pad accessory may be added to the pad 126 to facilitate yoga style exercises with the device 100 or 200. Separate anchor bands or straps 206 may be utilized that each have an individual door anchor such that the straps 206 may be attached to both sides of the door, to alter the angle of pull of the cords 202. Such a configuration may be used to control the amount of lift from the floor. Interchangeable resistance members could also be used to match the individual user's mass and preferred exercise style. The ring 320 may be replaced with a snap shackle attached to the cord 202 or an adjustable spring loaded clamp, if maintenance of a predetermined angle provided by segments of cord 318 to the tray 302 is desired.

In another alternative, the handles 340 may be constructed differently than that shown in that they may be more ergonomically shaped, and/or controls may be integrated into the handles 340 to control signals sent to and from the receiver/controller 108, control the camera 106 or change selections on the display 110. These are only exemplary variations.

Figure 10:
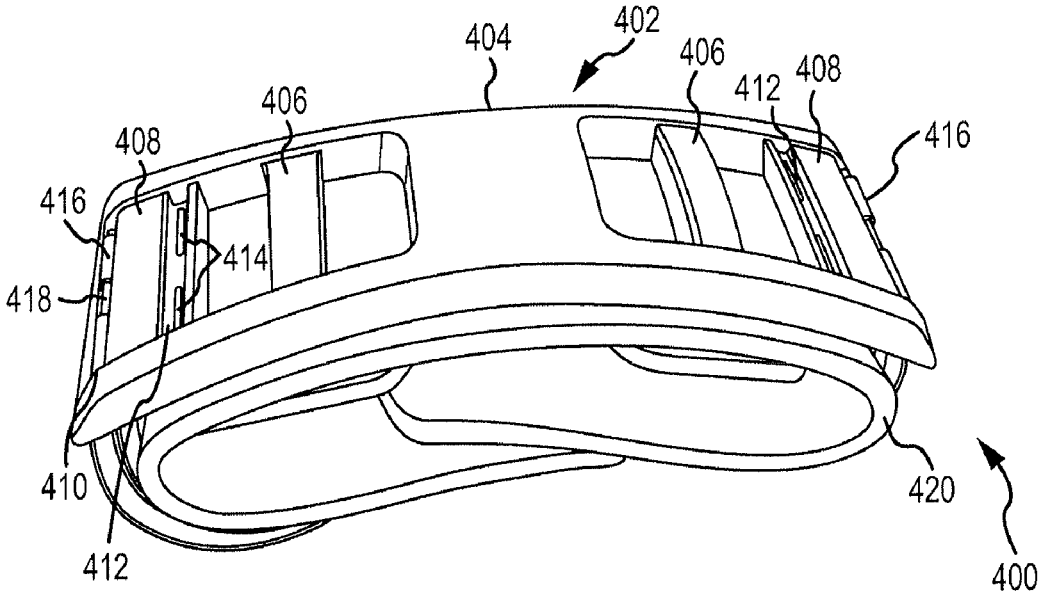
FIG. 10 is an outer folded perspective view of an alternative belly pad in accordance with the present disclosure.
Figure 11:
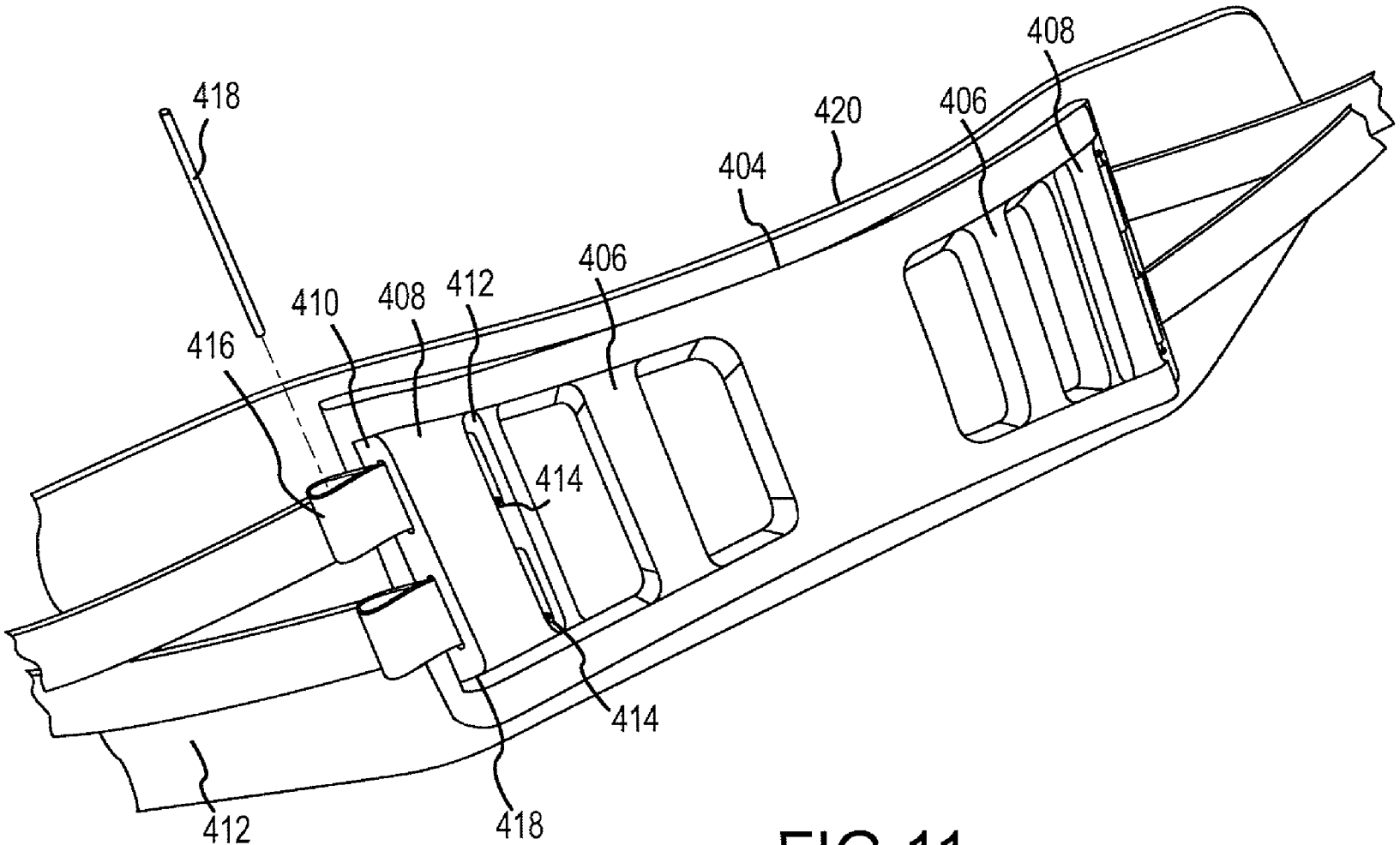
FIG. 11 is an outer unfolded perspective view of the alternative belly pad shown in FIG. 10.
Figure 12:
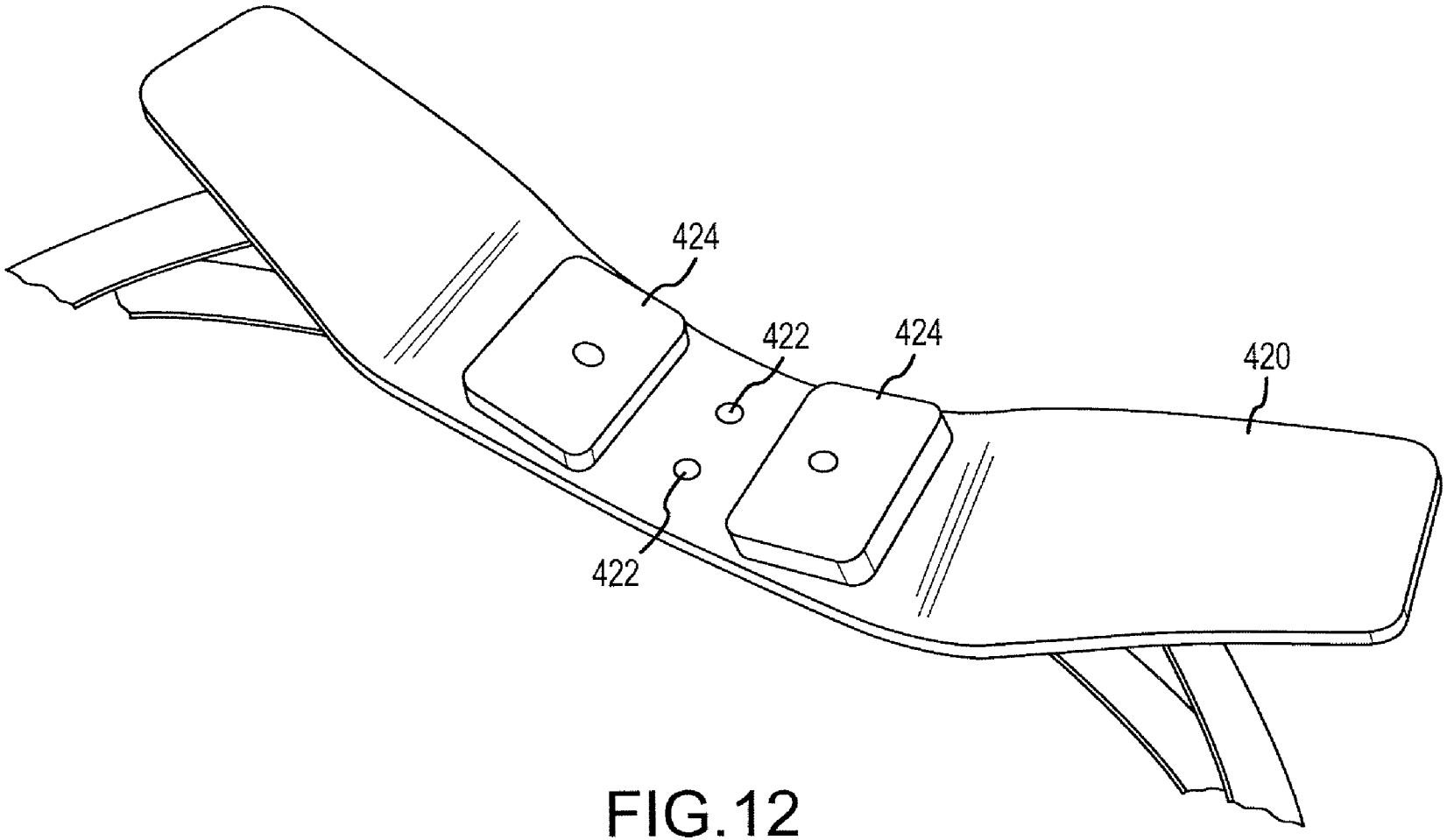
FIG. 12 is an inner unfolded perspective view of the alternative belly pad shown in FIG. 10.

An exemplary further alternative embodiment of a belly pad assembly 400 is shown in FIGS. 10 through 12. FIG. 10 is a perspective outer view of the belly pad assembly 400. The belly pad assembly 400 includes an elongated, generally rigid molded polymeric plate member 402 that is designed to be positioned laterally across a person's abdomen and the upper front of the hip bones. This plate member 402, when held upright, has a generally flat (vertically) and curved (horizontally) shape and has a central portion 404. The plate member 402 may optionally include oppositely curved handle portions (not shown) extending from opposite ends of the central portion 404.

The member 402 may be a one piece molded body and may be formed with a cushioned exterior surface. Formed adjacent each end of the central portion 404 are a pair of spaced vertical ribs 406 and 408.

The outermost rib 408 at each end of the central portion 404 is positioned between and defined by two generally vertical laterally spaced outboard and inboard recesses 410 and 412. Each recess 410 and 412 has a pair of vertically aligned slots 414 extending through the central portion 404. One end of a strap 416 is threaded through one of the slots 414. The other end of the strap 416 is similarly threaded through the other of the slots 414. Each end of the strap 416 has a loop sewn into it. An anchor rod 418 is threaded through the loops and the rod 418 pressed into the outboard recess 410 to fasten and retain the ends of the strap 416 to the plate member 402.

Alternatively, if the person using the belly bar/pad 400 has narrow hips, the ends of the straps 416 may be threaded through the slots 414 in the inboard recesses 412. In this case the anchor rod 418 would be threaded through the loops in the ends of the strap 416 and the rod pressed into the recesses 412. Additional ribs, recesses and slots could alternatively be provided to facilitate further adjustment for users having different hip widths.

The straps 416 each connect to a D ring, snap ring or carabineer as in the embodiments 200 and 300 shown above with reference to FIGS. 2 and 7 which in turn attach to cords 202.

Referring now to FIG. 11, an unfolded outer perspective view the belly pad assembly 400 is shown. Behind the plate member 402 is a cushion 420 that extends around the users waist beneath the plate member 402 and behind the straps 416 as is shown by the dashed lines in FIG. 7. This cushion 420 is preferably a foam sheet cushion material and may be closed cell or open cell in structure. The cushion 420 is fastened to the plate member 402 by fasteners such as rivets 422 as shown in FIG. 12.

Also shown in FIG. 12 are optional pads 424 that may simply provide additional cushioning for the user and/or may carry pressure sensors 128 and 130 as described above for use with the first embodiment 100. Accordingly, it is to be understood that the assembly 400 is an alternative to the belly bar/pad 300 for use in the system 100 and in the apparatus 200 described above.

Accordingly, all such alternatives, variations and modifications are intended to be encompassed within the scope of and as defined by the following claims.

What is claimed is:

1. A runner restraint device adapted to be elastically tethered to a stationary object, the runner restraint device comprising:

a generally rigid belly pad having a generally elongated curved body portion with opposite ends, the body portion having a vertical rib adjacent each end of the body portion and a pair of laterally spaced vertical recesses defining each of the vertical ribs, each recess having a pair of vertical slots therein;

a first strap having one strap end extending through one of the vertical slots and another strap end extending through the other vertical slot in one of the vertical recesses, wherein the ends of the first strap are removably retained in the one of the vertical recesses by a rod carried in that vertical recess;

a second strap having one strap end extending through one of the vertical slots in a vertical recess adjacent the other end of the body portion, wherein the ends of the second strap are removably retained in the one of the vertical recesses adjacent the other end of the body portion by a rod carried in that vertical recess;

a first cord having one end connected to the first strap and an opposite end connected to one end of an elastic member and wherein another end of the elastic member is connected to an anchor member; and a second cord having one end connected to the second strap and having an opposite end connected to one end of another elastic member and wherein another end of the another elastic member is connected to the anchor member.

2. The device according to claim 1 wherein the belly pad has an outer shape complementary to a person's pelvis and lower abdominal area.

3. The device according to claim 1 further comprising a cushion fastened to the belly pad between a user and the belly pad.

4. A belly pad for a runner restraint device comprising:

a curved elongated plate member for abutting against a person's abdomen and hips during exercise, the plate member having opposite ends and a body portion therebetween, the body portion having at least one vertical rib adjacent each end and a pair of laterally spaced apart vertical recesses defining each of the vertical ribs, each recess having a pair of vertically aligned slots therein extending through the body portion, each pair of slots adapted to receive ends of a strap therethrough, wherein each recess is shaped to receive and removably retain a rod therein carrying the strap ends.

5. The belly pad of claim 4 further comprising a second vertical rib adjacent to and spaced from the at least one vertical rib adjacent each end of the body portion.

6. The belly pad of claim 4 further comprising a flexible cushion fastened to an inner surface of the plate member.

7. A belly pad for a runner restraint device comprising:

a curved elongated plate member for abutting against a person's abdomen and hips during exercise, the plate member having opposite ends and a body portion therebetween, the body portion having at least one vertical rib adjacent each end and a pair of laterally spaced apart vertical recesses defining each of the vertical ribs, each recess being shaped to receive and hold a cylindrical rod therein, each recess having a pair of vertically aligned slots therein extending through the body portion, each slot configured to receive therethrough on end of a strap having a loop formed at the end thereof, wherein each recess is shaped to receive and removably retain the cylindrical rod therein threaded through the loops of the strap ends.

8. The belly pad of claim 7 further comprising a second vertical rib adjacent to and spaced from the at least one vertical rib adjacent each end of the body portion.

9. The belly pad of claim 7 further comprising a flexible cushion fastened to an inner surface of the plate member.

* * * * *

UNITED STATES PATENT AND TRADEMARK OFFICE

CERTIFICATE OF CORRECTION

PATENT NO. : 8,221,293 B2
APPLICATION NO. : 13/078685
DATED : July 17, 2012
INVENTOR(S) : Jonathan Hoffman and Amit Barak It is certified that error appears in the above-identified patent and that said Letters Patent is hereby corrected as shown below:

Column 10, line 46, claim 7: replace “on” with --one--.

Signed and Sealed this
Fourth Day of December, 2012

David J. Kappos

David J. Kappos
*Director of the United States Patent and Trademark Office*